US005382141A

United States Patent [19]

Stinessen

[11] Patent Number: 5,382,141

[45] Date of Patent: Jan. 17, 1995

[54] COMPRESSOR SYSTEM AND METHOD OF OPERATION

[75] Inventor: Kjell O. Stinessen, Oslo, Norway

[73] Assignee: Kvaener Rosenberg a.s. Kvaerner Subsea Contracting, Oslo, Norway

[21] Appl. No.: 98,391

[22] PCT Filed: Feb. 6, 1992

[86] PCT No.: PCT/NO92/00023

§ 371 Date: Sep. 16, 1993

§ 102(e) Date: Sep. 16, 1993

[87] PCT Pub. No.: WO92/14061

PCT Pub. Date: Aug. 20, 1992

[30] Foreign Application Priority Data

Feb. 8, 1991 [NO] Norway ..... 910499

[51] Int. Cl.[6] ..... F04B 47/06

[52] U.S. Cl. ..... 417/423.8; 417/902; 417/423.3; 415/116; 415/175; 166/105.5

[58] Field of Search ..... 415/116, 175; 417/423.3, 423.8, 902, 423.11; 166/105.5

[56] References Cited

U.S. PATENT DOCUMENTS

| | | | |
|---|---|---|---|
| 1,736,002 | 11/1929 | Frickey et al. | 415/175 |
| 3,746,472 | 7/1973 | Rupp | 415/175 |
| 4,065,232 | 12/1977 | Stratienko | 415/175 |
| 4,596,510 | 6/1986 | Arneth et al. | 415/175 |

FOREIGN PATENT DOCUMENTS 162782 6/1989 Norway .

*Primary Examiner*—Edward K. Look
*Assistant Examiner*—James A. Larson
*Attorney, Agent, or Firm*—Merchant, Gould, Smith, Edell, Welter & Schmidt

[57] ABSTRACT

In the operation of a compressor system in a subsea station for transporting a well stream, separated well stream gas is supplied to a compressor (12, 13) which is arranged with its motor (8) in a common drive atmosphere within a pressure shell (21). As the drive atmosphere there is used a suitable, continually supplied dry extraneous gas, which is supplied to the well stream. There may be used a suitable dry extraneous gas which is stored in liquid form in an insulated container. There is also described a compressor system wherein there may be used as the drive atmosphere a continuously supplied, suitable dry extraneous gas.

6 Claims, 2 Drawing Sheets

COMPRESSOR SYSTEM AND METHOD OF OPERATION

The invention relates to a method of operating a compressor system in a subsea station for transporting a well stream, where separated gas from a well stream is supplied with energy in a compressor which is arranged with its motor in a common drive atmosphere within a pressure shell, said compressor and motor having lube oil lubricated bearings that form part of a lube oil circuit having a lube oil sump open to the drive atmosphere in the pressure shell, and a compressor system in a subsea station for transporting a well stream, comprising a compressor with a motor in a common drive atmosphere within a pressure shell, a gas chamber and a gas suction line between the gas chamber and an inlet in the compressor, and a lube oil circuit comprising a lube oil sump open to the drive atmosphere, a lube oil pump, bearings in the motor and compressor, and a lube oil flow line to the bearings.

The invention has been developed particularly in connection with the development of a subsea station for pumping a well stream. Oil and gas production at sea today conventionally takes place in the following manner:

Production wells are drilled from a platform down into the hydrocarbon reservoir. The platform is positioned above wave height on a base structure standing on the ocean floor or floating on the surface of the sea. The wellhead valves, which shut off the reservoir pressure, are placed on the platform, usually directly above the production wells.

The oil, which is found under high pressure in the hydrocarbon reservoir, contains large amounts of dissolved gas. The oil's capacity to retain the dissolved gas decreases with lowered pressure and rising temperature. When the oil flows up through the production well from the reservoir and past the wellhead valve on the platform, thereby causing the pressure to decrease, gas is then given off from the oil. A mixture of oil and gas (actually a mixture of liquid (oil/water) and gas) will therefore emerge on the uppermost side of the wellhead valve.

This mixture of liquid and gas is conducted to a processing plant, generally located on the platform. The function of the processing plant is primarily to separate oil and gas and to render the oil suitable for transport, and the gas suitable for transport or for return to the reservoir.

Since this process requires energy, and hydrocarbons are inflammatory, there must be built a number of auxiliary functions and emergency systems around the processing plant. In addition, operation of the processing and the auxiliary and emergency systems requires manpower which, in turn, requires housing accommodations and numerous other functions. For this reason, the structures become large and expensive, both in terms of investment and operation. At greater sea depths, the cost problems are aggravated when the platform and its processing plant are to stand on an expensive base structure either floating or anchored to the seabed.

Presently there are major development projects underway with the aim of reducing these costs. These include technology developed to enable placement of the wellhead valves on the ocean floor—a so-called subsea production plant. This has major economic significance because the number of platforms that are necessary to drain a hydrocarbon reservoir may thereby be reduced. A subsea production plant is situated above an area of the hydrocarbon reservoir that cannot be reached with production wells from the platform.

The production wells in a subsea production plant are drilled from floating or Jack-up drilling vessels. Oil and gas from the hydrocarbon reservoir flow upward and past the wellhead valves on the ocean floor and then proceed as a two-phase flow (oil and gas in mixture) in a pipeline connecting the subsea production plant with the platform. Such a two-phase flow results in the formation of liquid slugs that produce powerful fluid knocks, uncontrolled flow conditions and a severe pressure drop within the pipeline. Therefore, the distance between the subsea production plant and the platform cannot be great. A practical limit is currently considered to be about 15 kilometers.

Technical solutions capable of increasing this distance would have major economic potential. Their most extreme consequence would be to render the platform superfluous, with the wellhead valves standing on the ocean floor at the hydrocarbon reservoir and the processing, auxiliary and emergency facilities being located on shore.

Work is also currently in progress on major development projects to solve the problem of transporting the oil/gas mixture across great distances. Some of these projects have the objective of supplying pressure to the oil/gas mixture by placing two-phase pumps on the ocean floor thereby compensating the pressure decrease. Other projects aim at separating oil and gas on the ocean floor and then pumping oil and gas in their respective pipelines to a processing plant. Oil and gas are thereby imparted with the necessary transport energy for their effective transport further on to the receiving station. Liquid and gas are each conducted in a separate pipeline, but it would be possible to run the liquid and gas pipelines together in a multi-phase transport conduit if this were found to be the optimal solution.

The production from a plurality of wells may be collected and transported further in a common stream. One problem in this connection is the occurrence of varying flow pressures from the wells. This may be solved by conducting the well streams via separate stations where the flow pressure is adapted to a common value, after which the streams are brought together in a manifold station for further transport.

The transport of an unprocessed well stream over long distances to shore-based processing plants offers major potential advantages. The placement of as much as possible of the heavier, voluminous processing plant on shore gives greater freedom with respect to optimal design, as it is not necessary to cope with the weight and space restrictions presented by permanently installed and, in particular, floating platforms.

In order to transport a well stream over long distances to the shore or to existing processing platforms with available capacity a distance away, it will be necessary to use subsea pumping stations. Their placement on the seabed provides several advantages. Compressors and pumps will stand amidst a cooling medium (the sea water) which retains a nearly constant temperature. The risk of explosion is eliminated, and the system will be unaffected by wind, weather and icing. Major savings can be realized in connection with platform costs, housing accommodation costs and transport of personnel and equipment to and from the shore.

Subsea pumping stations are, however, encumbered with several disadvantages and unsolved problems. For example, simple dally inspection and maintenance would be impossible. Systems and components for controlling and monitoring remotely situated subsea stations are untried technology. The necessary electrical energy must be transmitted over long distances, and the connection to the equipment in the subsea station must be done in a satisfactory manner.

All equipment and components must have good quality and high reliability. The maintenance program must be designed in accordance with established systems, with the possibility for replacement of equipment. Assembly and dismounting should be possible by means of unmanned diving vessels and/or hoisting devices controlled from the surface. Service/maintenance, to be carried out by the replacement of complete units should be possible to carry out at desired intervals of at least 1 to 2 years. Operational control and adjustment should be kept to a minimum, and supervision of the station during operation should preferably be unnecessary.

There is known from NO-PS 162.782 a compressor unit comprising a motor and a compressor, which compressor unit is completely closed on the outside and forms an integrated whole, where the need for shaft seals is greatly reduced. The compressor unit may operate over long periods without supervision and maintenance and can be used in subsea stations for transporting hydrocarbon gas. The motor and as compressor are placed in a common drive atmosphere within a pressure shell. The drive atmosphere is formed of the gas that is compressed in a compressor, and it has a pressure level approximately equal to that at the inlet of the compressor. A gas line provides communication between a location in front of the compressor's inlet and the inside of the pressure shell, i.e., the drive atmosphere, and a cooling loop is built into this gas line. The motor and compressor have oil lubricated bearings with a lube oil circuit connected therewith, including a lube oil sump open to the drive atmosphere. The purpose of providing the gas line with a built-in cooling loop is to ensure that the condensate does not precipitate in the compressor, but outside it, with return of the condensate to the compressor's inlet side. Necessary chilling for the cooling loop is provided by the surrounding sea water.

Also known is a subsea station wherein a separator, a pump unit and a compressor unit are constructed together as a compact unit with the three components arranged in a column structure with the pump unit at the bottom, followed by the separator, and with the compressor unit at the top (U.S. Ser. No. 07/46038, filed Mar. 1, 1990, and NO patent application no. P890057, respectively.) This compact unit, containing a simple separator, a pump and a compressor, may be placed on the ocean floor. The unit splits the hydrocarbon stream from one or several subsea wells into a gas and liquid phase. The pressure in the gas and liquid is then increased to enable the transport of the production stream over long distances. Transport from the unit may take place either in a common pipeline or in separate pipelines for the oil and gas. The compact unit could be installed by using a drilling rig or, for example, a modified diving vessel with a large moon pool. Installation and/or replacement may be done in a simple manner. Service/maintenance, which would be carried out by the replacement of the complete unit, could be done at desired intervals of at least 1 to 2 years. Operational control and adjustment could be kept to a minimum.

The compact embodiment enables the avoidance of long fluid-carrying lines in the station, thus also making it possible to avoid pressure loss within these lines. The number of necessary valves and couplings is greatly reduced. Because fluid line connections in the station are to a large degree avoided, one also avoids the undesirable effects resulting from so-called slugs, i.e., series of liquid and gas bubbles. Positioning the compressor as the uppermost unit enables self-drainage of the gas. The gas will often remain at the dew point and will therefore readily create condensation within the gas-carrying sections. Any liquid formed within the compressor portion will run down from the compressor part or the gas part.

The pump unit underneath will be self-draining in the same manner as the compressor unit situated above it. In the same manner as condensed gas drips down from the upper compressor unit, any gas in the pump unit beneath will bubble up in the separator.

The compressor and its motor are arranged within a common pressure shell, the bottom section of which is formed as a reservoir or sump for lube oil for the bearings. Such a compressor represents a closed system, free of external influences. Because operations within the pressure shell may be carried out with the same gas atmosphere and the same pressure in the individual departments, the need for internal sealing (shaft seals) will be nearly eliminated.

For placement in surroundings with difficult access, i.e., in a subsea station, it is particularly important to have a compressor aggregate that is as autonomous as possible, with a lifetime or maintenance-free period which is relatively predictable and of maximum length. The lube oil system is particularly important in this connection.

The purpose of the invention is to ensure that the drive atmosphere in the compressor is one that does not break down the lube oil. The particular objective of the invention is therefore to provide for a "dry" or conditioned compressor drive atmosphere. By a suitable dry gas, in this connection, is meant a gas from which liquid cannot be condensed, under any operational or non-operating conditions, and which is itself of a nature that does not present an explosion risk and, in particular, does not have the effect off breaking down the lube oil in the lube oil system. It is especially advantageous that such a dry gas should be of a type that inhibits corrosion, i.e., that the content of $H_2S$ and $CO_2$ should be negligible in this connection. As examples of gases may be mentioned nitrogen, argon, methane, helium and hydrogen.

According to the invention, therefore, we propose a method of operating a compressor system in a subsea station for transporting a well stream wherein separated gas from the well stream is supplied with energy in a compressor which is arranged with its motor in a common drive atmosphere within a pressure shell, said compresor and motor having lubricated bearings that are part of a lube oil circuit with a lube oil sump open to the drive atmosphere within the pressure shell, the characterizing feature of the method according to the invention being that the drive atmosphere is provided by the continuous supplying of a suitable dry extraneous gas, which is conducted from the pressure shell to the well stream gas.

Such an introduction of dry extraneous gas at a certain excess pressure to the motor chamber, gear and lube oil system as a common drive atmosphere has the effect of eliminating the danger of condensate formation and associated breakdown of the lube oil in the lube oil system. Improved control of the pressure conditions is achieved, thereby ensuring that the flow will be in the right direction. The drive atmosphere is of such a nature that there will be no danger of explosion in the oxygen-free environment, and the supply of dry gas without an $H_2S$ and $CO_2$ content will also prevent corrosion in the compressor system.

The gas that forms the drive atmosphere may be supplied either from one or more pressure gas cylinders in the subsea station or through pipes from a nearby platform or onshore station. It would be particularly advantageous to use a suitable dry extraneous gas that is stored in liquid form in an insulated container in the subsea station.

The flow quantity of the extraneous gas will be dependent on the type of seal used in the compressor. As an example of relevant seals one may mention dry gas seals, labyrinth seals with carbon rings and open labyrinth seals.

Taking into consideration the friction conditions in the motor and the optional gear, it would be advantageous to use a gas having as low a molecular weight as possible, i.e., hydrogen, helium or methane. If helium is used, the danger of explosion is eliminated also if the compressor system is filled with gas over water prior to submersion to the subsea station, or if the compressor system is taken up while filled with gas.

The invention also relates to a compressor system in a subsea station for transporting a well stream, comprising a compressor with a motor in a common drive atmosphere within a pressure shell, a gas chamber and a gas suction line between the gas chamber and an inlet in the compressor, and a lube oil circuit comprising a lube oil sump open to the drive atmosphere in the pressure shell, a lube oil pump, bearings in the motor and compressor, and a lube oil line to the bearings, the characterizing feature of the compressor system according to the invention being a means for supplying a suitable dry extraneous gas as the drive atmosphere in the pressure shell and means for discharging gas from the drive atmosphere to the gas chamber.

The drive atmosphere in the lube oil sump may advantageously be connected with the discharge of gas to the gas chamber through a flow line provided with a throttle, thereby ensuring the correct direction of gas flow through the seals in the compressor.

The means for supplying suitable dry gas may advantageously include a pressure cylinder-dry gas reservoir in the subsea station, and particularly advantageous would be one or more insulated containers which hold the appropriate dry gas in liquid form. Constructively one may readily ensure that the unavoidable decoction is of a magnitude sufficient to provide a suitable drive atmosphere in the pressure shell at all times.

The invention will now be described in more detail with reference to the drawings, wherein:

DETAILED DESCRIPTION OF THE PREFERRED EMBODIMENTS

Figure 1:
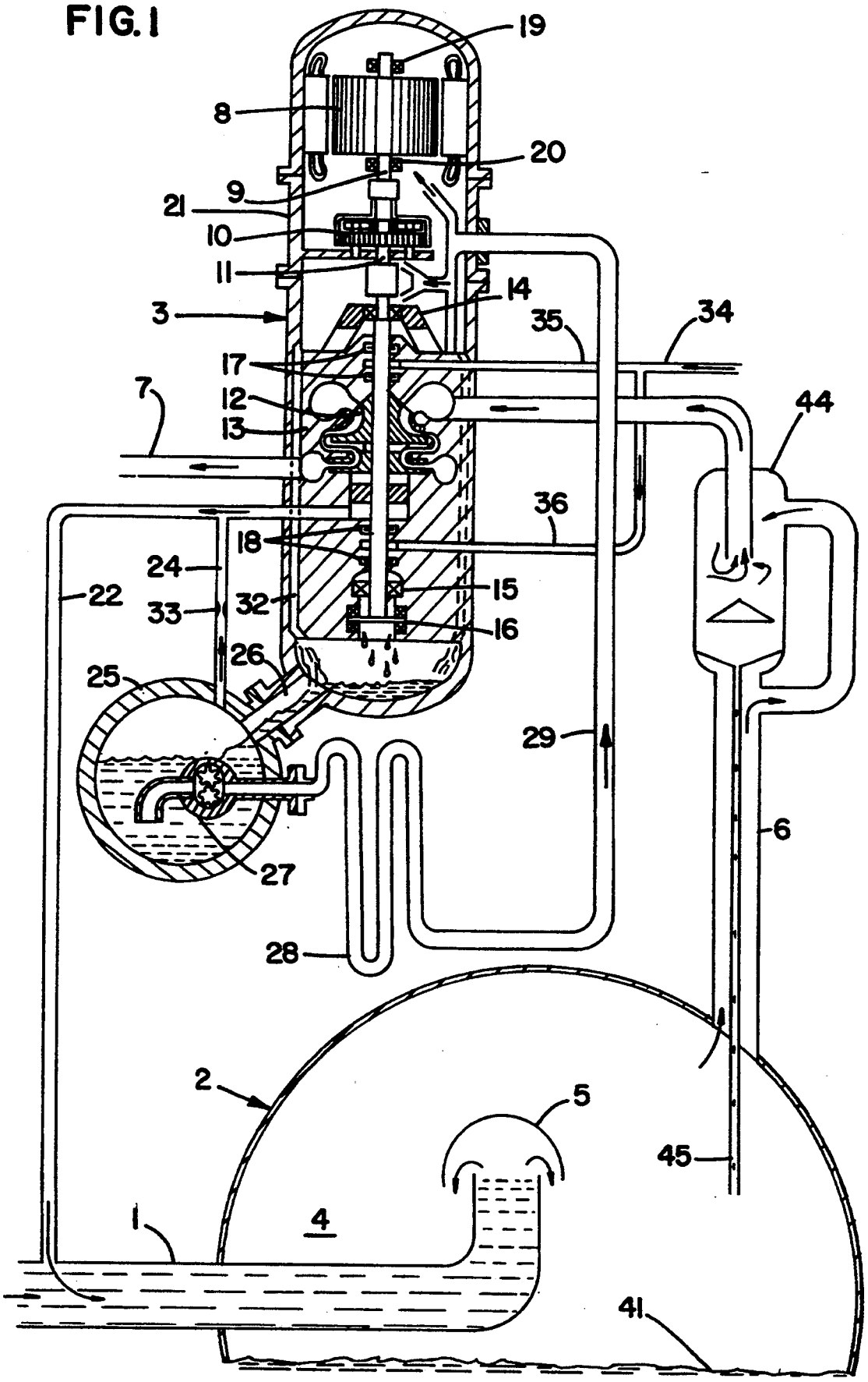
FIG. 1 in semi-schematic form shows a compressor system according to the invention.

The compressor system shown in FIG. 1 is a part of a subsea station for production of hydrocarbons. The system comprises a separator 2 and a compressor 3. A well stream (oil/water/gas/particles) is supplied to the separator 2 through a pipeline 1 from one or more wellheads, not shown, on the ocean floor. Pipeline 1 flows as shown into the gas chamber 4, with splash deflector 5, in the separator 2. A suction line 6 runs from the separator's gas chamber 4 to the compressor 3, where the gas is supplied with transport energy and then proceeds further through outlet conduit 7.

The compressor 3 is here designed as a vertically oriented centrifugal machine. The compressor's motor 8 is at the top, and the engine shaft 9 is connected to an appropriate gear 10, which in turn is connected to the drive shaft 11 of the actual compressor. The compressor shown is a two-stage compressor. The compressor's impeller is indicated by 12 and the compressor housing is designated by 13. The drive shaft 11 of the compressor is mounted at the top in bearing 14 and at the bottom in bearing 15, together with thrust bearing 15. The compressor shaft 11 is sealed off at the top and bottom of the compressor housing 13 by means of seals 17, 18, here only indicated roughly.

The motor 8, i.e., its drive shaft 9, is mounted as shown in an upper bearing 19 and a lower bearing 20.

The motor 8, the gear 10 and the compressor housing with the rotor, are arranged as shown within a common pressure shell 21. Within this pressure shell there is a common gas atmosphere, the so-called the drive atmosphere. Seals 17 and 18 delimit a compressor process atmosphere.

From compressor housing 13 runs an open flow line connection 22, as shown, into pipeline 1, which flows into the separator's gas chamber 4 and supplies a well stream to the separator. Flow line 22 exits from the compressor housing 13 below a balance piston 23 for the compressor's drive shaft. Flow line 22 thus runs from the compressor process atmosphere to the pipeline 1 for the well stream. Between flow line 22 and a lube oil sump 25 runs a gas line 24 with a built-in throttle 33. The lube oil sump has, as shown at 26, an open communication with the interior of pressure shell 21 and is therefore a part of the drive atmosphere. The lube oil sump 25 is at the same time a part of the lube oil circuit which comprises a lube oil pump 27, a lube oil cooler 28, and a lube oil flow line 29, which goes to the respective bearings in the motor, gear and compressor. The lube oil flow line 29 is distributed, as shown, into branch pipes to the various bearings, although in this case not to the uppermost bearing 19, which here is a self-lubricated bearing. The lube oil collects at the bottom of pressure shell 21. The invention provides for the necessary channels or ducts 32 in this connection.

A pipe 34 leads from an extraneous gas store, not shown, and divides here into two branch pipes 35 and 36 which at compressor shaft 11 flow into the respective sealing means 17 and 18. The gas supplied through pipe 34 forms the drive atmosphere within the pressure shell. The discharge of gas from the drive atmosphere to gas chamber 4 in the separator takes place through flow line 22. From the lube oil sump 25, a flow line 24 runs, as shown, to line 22. The throttle choke 33 ensures the desired direction for the gas flow, as indicated with the arrows.

The gas suction line 6 includes a scrubber 44. From the scrubber chamber runs a return pipe 45, which extends downward into the liquid component 41 in the separator. Separator 2 is connected, in a manner not shown, to a pump, which draws liquid from the separator; see, for example, the publicly available Norwegian patent application no. P 890057, mentioned in the introduction herein.

Figure 2:
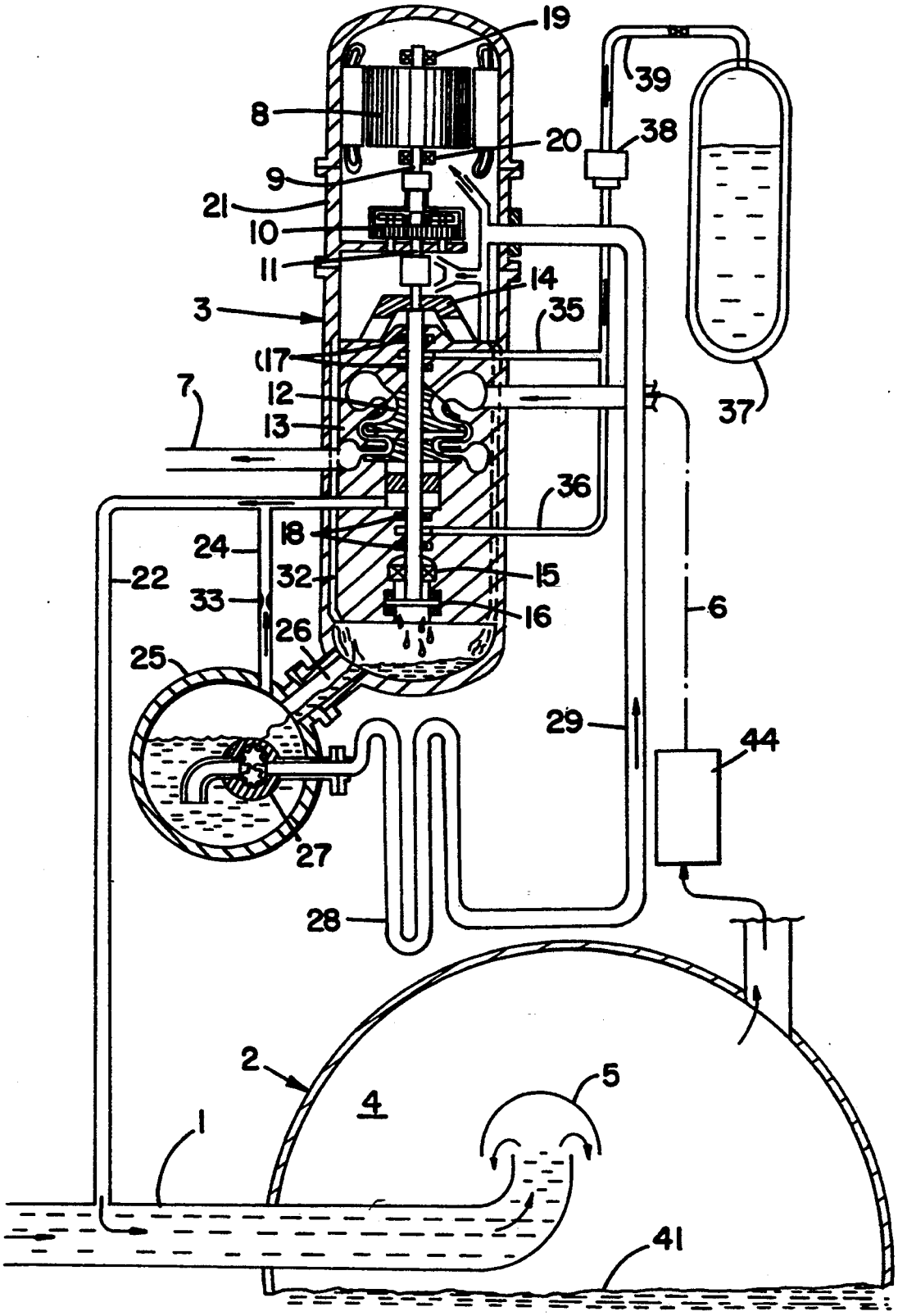
FIG. 2 shows a compressor system similar to that in FIG. 1, but wherein the extraneous gas is stored in liquid form in an insulated container.

The embodiment in FIG. 2 is identical with the embodiment in FIG. 1, with the exception that in FIG. 2 there is indicated an insulated container 37 which through a connector 38 is coupled to pipe 34. Thus, while the system in FIG. 1 is supplied with extraneous gas in a manner not shown in greater detail, for example from a nearby platform, the supply of extraneous gas in the system in FIG. 2 is provided from a container located in the subsea station. This container is insulated and may, for example, contain liquid nitrogen. The decoction passes through an adjustable pipe 39 to connector 38 and further therefrom through pipe 34 and branch pipes 35, 36 to the sealing areas in the compressor. Pipe 39 is advantageously formed as a capillary tube, adapted to the quantity of decoction in the insulated container 37.

In FIG. 2 the gas line 6 is only indicated symbolically, with the associated scrubber 44.

In FIG. 1 and FIG. 2, the compressor system is shown in its operational mode. Arrows indicate the prevailing flow directions for the well stream, well stream gas, extraneous gas and lube oil. The compressor draws gas from the separator gas chamber 4 through suction line 6. In the scrubber 44 the separation is carried out in known per se manner, and liquid and any drops that are produced are returned to the separator through return pipe 45. Within the compressor the gas is supplied with energy and sent on through outlet conduit 7. Lube oil for the various bearings flows in the lube oil circuit. The lube oil pump 27 in the lube oil sump forces the lube oil through the lube oil cooler 28 chilled by the surrounding sea water, wherefrom the lube oil continues further to lube oil flow line 29 and to the bearings within the pressure shell 21. The lube oil is collected at the bottom of the pressure shell and runs down into the lube oil sump 25. The extraneous gas supplied, for example from container 37 in FIG. 2, provides for the maintenance of a desired drive atmosphere in pressure shell 21. Propellant gas is conducted out from the pressure shell through flow line 22 and to the well stream in pipeline 1 and thereby back to the gas chamber 4 in the separator.

As mentioned above, one can envision extraneous gas or sealing gas being supplied from a platform or shore if the distances are reasonable, or from cylinders or the like situated near the compressor unit on the ocean floor, as is shown in FIG. 2. The latter solution, i.e., storage of gas in liquid form on the seabed in a thermally insulated container, is regarded as particularly advantageous. With the selection of a suitable insulating capacity, the thermal transmittance from the sea water will result in a desired decoction of gas for use in the seals and in the drive atmosphere. By using nitrogen, for example, in a practical embodiment of the compressor system—depending on the type of shaft seal—a year's consumption of drive atmosphere gas could possibly be as low as in the range of about 2–5 $m^3$ of liquid nitrogen. As noted above, several types of gas could be used. The pressure in the storage container may be regulated in a manner known per se to the skilled person. The container may be equipped with a connector unit of known type, enabling it to be transported between sea level and the subsea station for make-up and preparation for a new operational period without depending on pulling up other components in the station.

I claim:

1. A compressor system in a subsea station for transporting a well stream, comprising a compressor (12, 13) with a motor (8) in a common drive atmosphere within a pressure shell (21), a gas chamber (4) and a gas suction line (6) between the gas chamber and an inlet in the compressor, and a lube oil circuit comprising s lube oil sump (25) open to the drive atmosphere in the pressure shell, a lube oil pump (27) bearings (19, 20, 14, 15, 16) of the motor (8) and compressor (11, 12, 13), and a lube oil flow line (29) to the bearings, characterized by means (34–36; 34–39) for supplying a suitable dry extraneous gas as the drive atmosphere in the pressure shell (21), and means (22,24,33) for discharging gas from the drive atmosphere to the gas chamber (4).

2. The compressor system according to claim 1, characterized in that the drive atmosphere in the lube oil sump (25) is connected with the discharge of gas to the gas chamber through a flow line (24) provided with a throttle (33).

3. The compressor system according to claim 1, characterized in that the means for supplying a suitable dry extraneous gas comprises a pressure cylinder-dry gas reservoir (37) in the subsea station.

4. The compressor system according to claim 3, characterized in that the pressure cylinder-dry gas reservoir is an insulated container (37) for receiving extraneous gas in liquid form.

5. A method of operating a compressor system having a motor in a subsea station for transporting a well stream, wherein separated gas from a well stream is supplied with energy in a compressor which is arranged with its motor in a drive atmosphere within a pressure shell, the compressor and motor having lube oil lubricated bearings that form part of a lube oil circuit having a lube oil sump open to the drive atmosphere in the pressure shell, characterized in that the drive atmosphere is provided by continuous supplying of a suitable dry extraneous gas, said extraneous gas being conducted from the pressure shell to the well stream gas.

6. A method according to claim 5, characterized in that said suitable dry extraneous gas is stored in liquid form in an insulated container.

* * * * *